US005148653A

United States Patent [19]

Scharch

[11] Patent Number: 5,148,653

[45] Date of Patent: Sep. 22, 1992

[54] BOXING MACHINE FOR RIMMED AMMUNITION

[76] Inventor: Daniel J. Scharch, 10325 County Rd. 120, Salida, Colo. 81202

[21] Appl. No.: 745,226

[22] Filed: Aug. 14, 1991

Related U.S. Application Data

[63] Continuation-in-part of Ser. No. 610,397, Nov. 7, 1990, Pat. No. 5,052,167.

[51] Int. Cl.[5] ..... B65B 35/34; B65B 19/34; B65B 5/06; B65B 43/54

[52] U.S. Cl. ..... 53/444; 53/448; 53/473; 53/148; 53/543; 53/247; 53/390; 198/761

[58] Field of Search ..... 53/142, 148, 151, 149, 53/539, 543, 525, 247, 390, 444, 446, 448, 475, 473, 236; 198/761, 762, 750, 770; 414/798.2, 798.4

[56] References Cited

U.S. PATENT DOCUMENTS

| | | | |
|---|---|---|---|
| 1,061,492 | 5/1913 | Peterson | 53/142 |
| 1,063,588 | 6/1913 | Peterson | 53/142 |
| 1,108,097 | 8/1914 | Peterson | 53/142 |
| 2,387,672 | 10/1945 | Mayberry | 53/525 X |
| 2,549,322 | 4/1951 | McKinsey | 53/525 |
| 2,632,588 | 3/1953 | Hoar, Jr. | 53/525 X |
| 2,995,880 | 8/1961 | Henebry | 53/148 X |
| 3,054,235 | 9/1962 | Edgerly et al. | 53/142 X |
| 3,133,623 | 5/1964 | Collins et al. | 53/142 X |
| 3,517,478 | 6/1970 | Winch et al. | 53/142 |
| 3,545,164 | 12/1970 | Middleton | 53/539 X |
| 3,794,088 | 2/1974 | Harvey | 53/390 X |
| 3,813,950 | 6/1974 | Ebersole | 198/761 X |
| 4,685,271 | 8/1987 | Ringer et al. | 53/390 X |
| 4,693,057 | 9/1987 | Rittinger et al. | 53/539 |

*Primary Examiner*—Horace M. Culver
*Attorney, Agent, or Firm*—Dorr, Carson, Sloan & Peterson

[57] ABSTRACT

A compact apparatus for loading bulk ammunition, particularly rimmed cartridges, into cartridge boxes. The apparatus includes a manifold having side walls, a rear wall and a removable front spacer bar. A tray pan is indexed beneath a plurality of parallel, spaced rails in the manifold. The rails are spaced apart a distance greater than the diameter of the cartridges but less than the diameter of the cartridge rims. The manifold is vibrated by an adjustable eccentric drive. Loose ammunition is poured onto the manifold and contained on there by the walls and gate. Once the holes of the cartridge boxes are substantially filled, the operator moves the rear gate to clear off the excess ammunition. The tray pan is then released from spring detents to remove the boxes from the apparatus.

20 Claims, 10 Drawing Sheets

Fig. 3
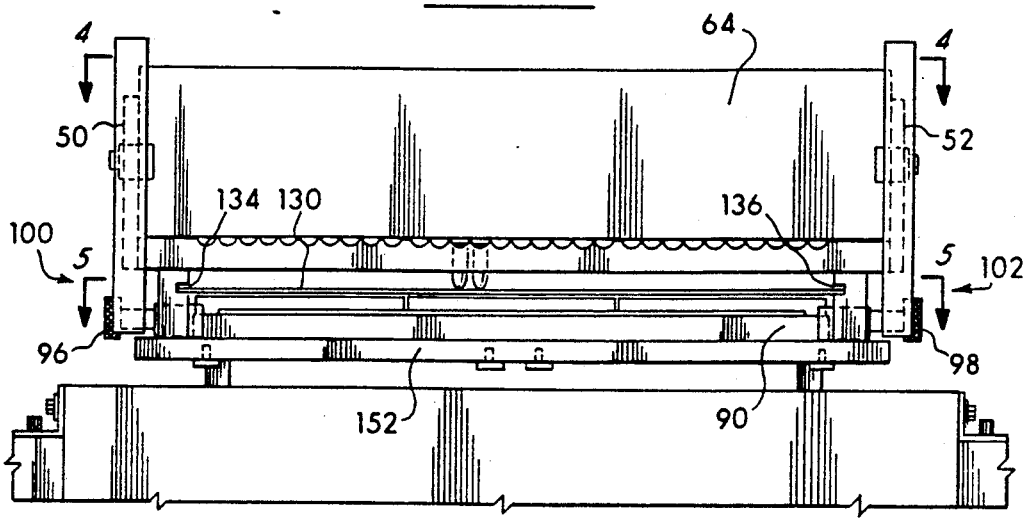
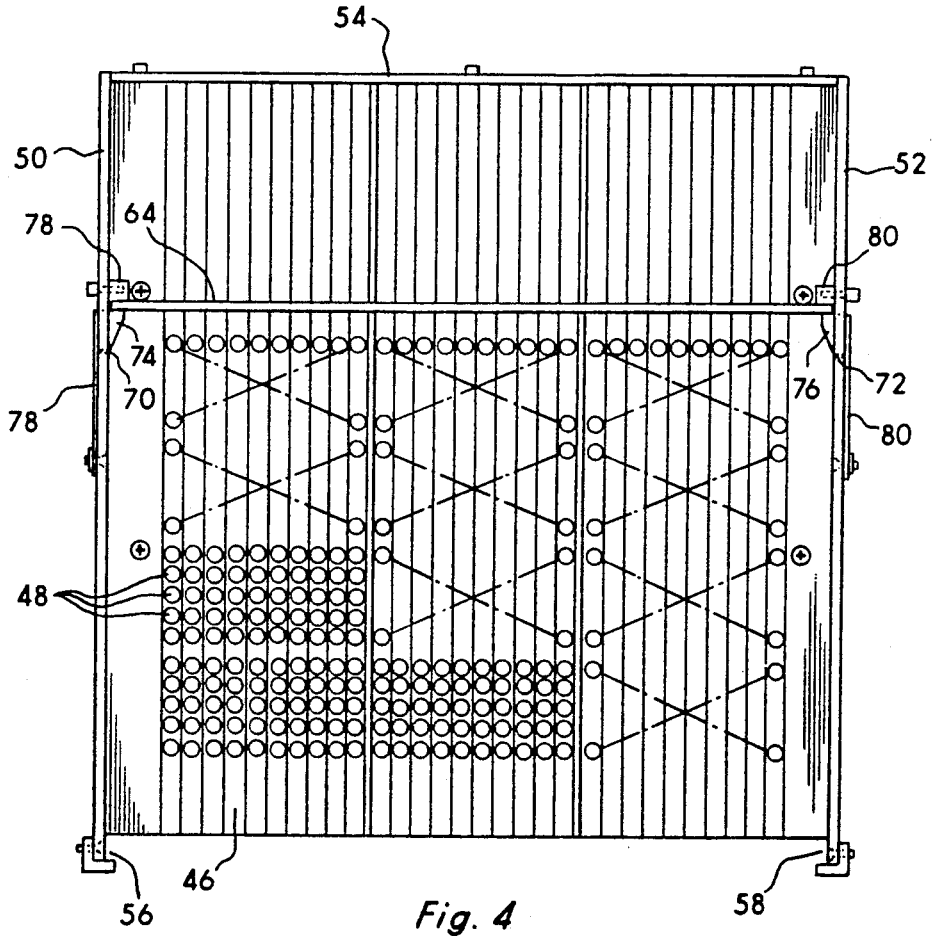
Fig. 4

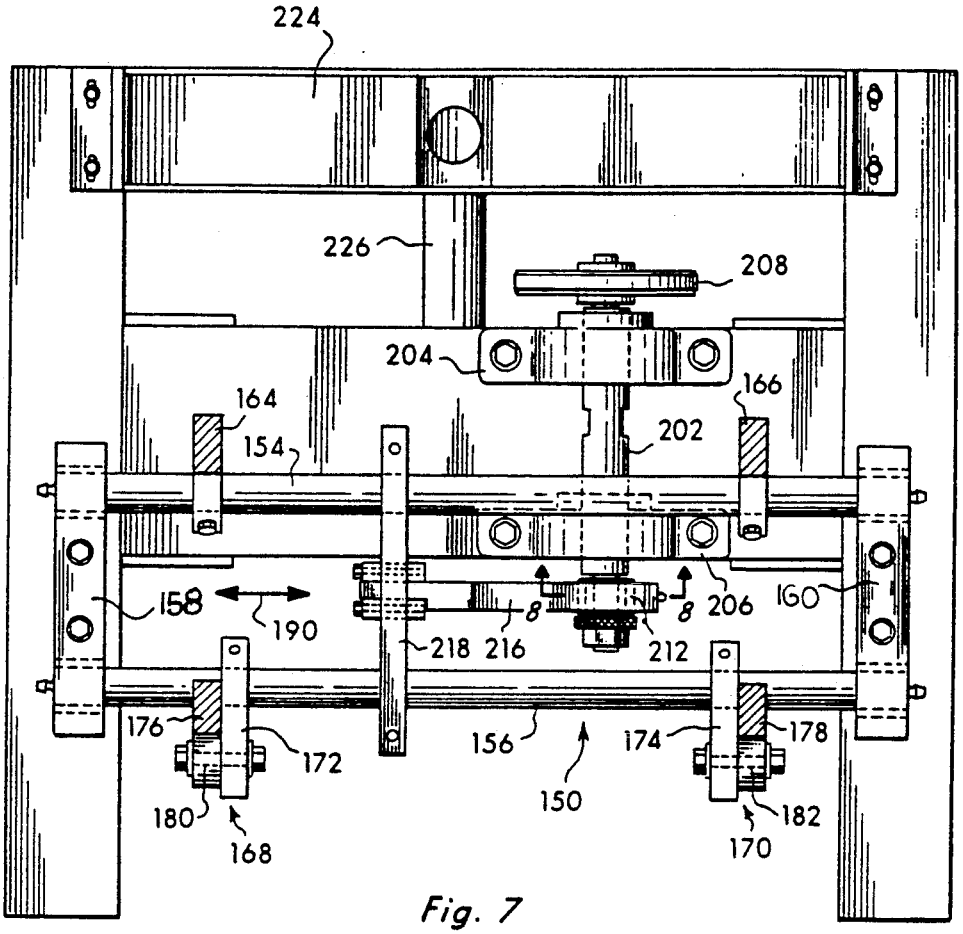
Fig. 7
Fig. 8
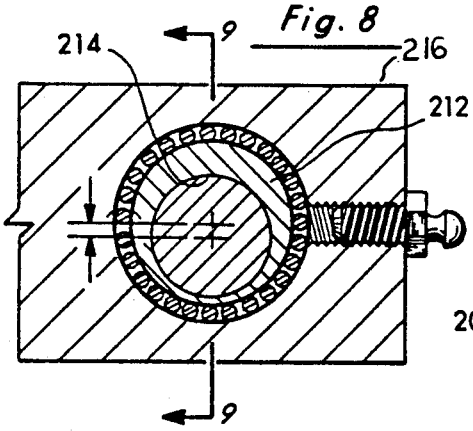
Fig. 9
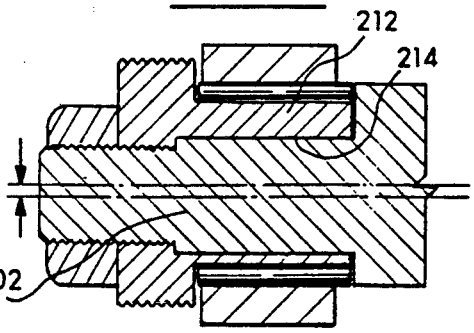

Fig. 11
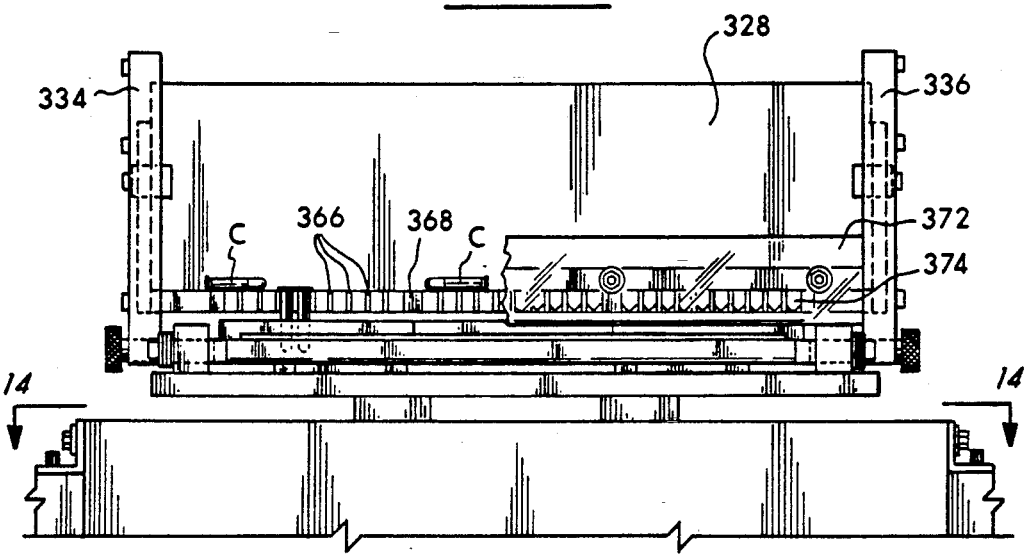
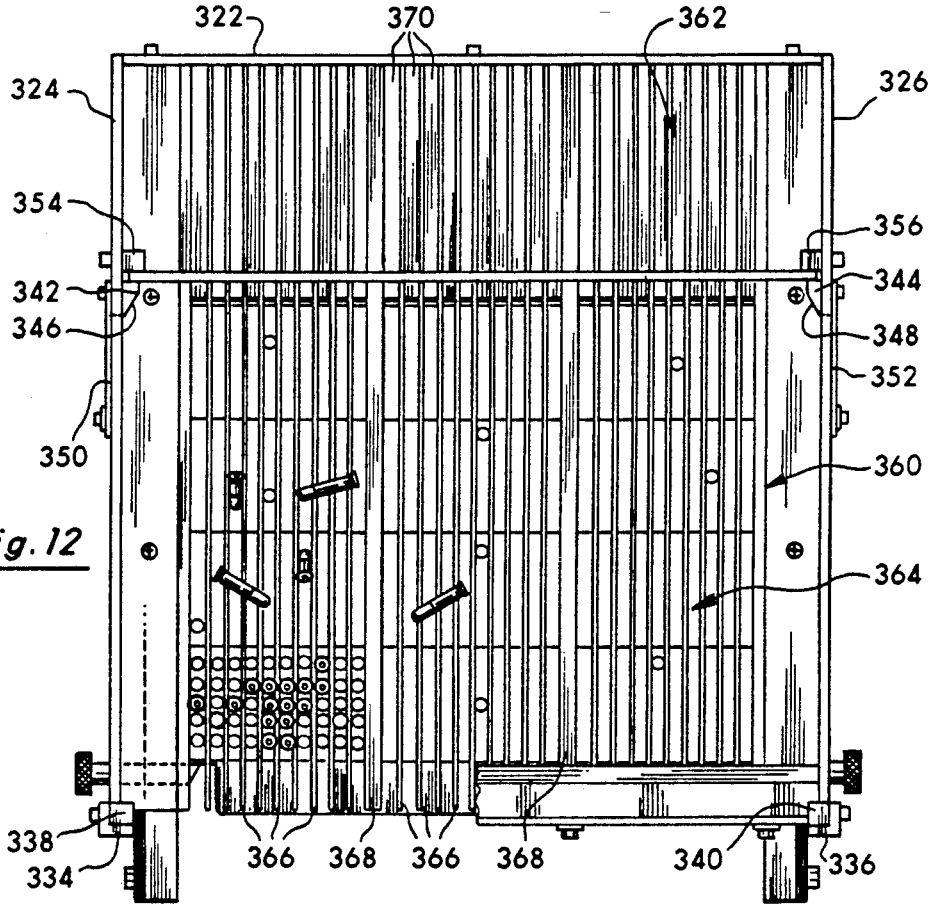
Fig. 12

BOXING MACHINE FOR RIMMED AMMUNITION

BACKGROUND OF THE INVENTION

Related Applications

This application is a continuation-in-part of Ser. No. 07/610,397, now U.S. Pat. No. 5,052,167.

1. Field of the Invention

This invention relates to an apparatus for loading bulk ammunition cartridges into cartridge boxes.

2. Statement of the Problem

Ammunition is manufactured in loose, bulk form that is loaded into cartridge boxes to be shipped and sold. Bulk ammunition has previously been loaded into the cartridge boxes by hand, a time-consuming and expensive procedure, or by the use of a box loading machine.

One known prior art box loading machine is manufactured by Smith and Wesson. This machine uses a large base assembly with a shaker table mounted on the base assembly. The shaker table is shimmed to be at an angle to the base and driven by a motor mounted externally on one side of the base assembly. The top of the base assembly forms a funnel into which the ammunition is poured. The operator must constantly pour loose, bulk ammunition onto the top of the base assembly, where the ammunition falls not only onto a sorting manifold, but also falls off the sides and the front of the manifold. In order for the machine to function efficiently, the manifold must be flooded at all times with an excessive amount of ammunition. Once all of the holes of the manifold are filled, then the excess ammunition is swept off the manifold and the bullet pan beneath the sorted ammunition is removed. This allows only the ammunition in the manifold to pass down into the ammunition trays. The excess ammunition passes down through the base assembly where it is collected in a bucket. The operator must constantly empty the bucket back into the machine.

The bullet tray pan is inserted into an area underneath the bullet manifold and held in place by a dowel pin which passes through the front of the manifold and the bullet pan and tray pan. The dowel pin must be removed in order for the bullet pan and the tray pan to be removed from the machine. The bullet pan is first removed, allowing the ammunition to drop into the cartridge boxes, then the tray pan is removed. A new tray pan containing empty cartridge boxes is inserted back into the machine, along with the bullet pan and the dowel pin is re-inserted.

This prior art machine can, at peak efficiency, load at best approximately 15,000 rounds per hour. Further, the construction of the machine requires the operator to bend over the machine, creating stress on the back of the operator.

The cumbersome design of this machine is due to the funnel design of the base assembly. The externally mounted motor extends even further into the work space around the machine. This machine requires approximately seven and one half square feet of operating room.

Thus, a need exists for a boxing machine having a higher rate of loading, a more compact machine, and a machine which is ergonomically designed for ease of operation.

3. Solution of the Problem

The present invention solves these and other problems by providing a box loading device which efficiently and rapidly loads ammunition into a tray pan, allows quick insertion and removal of the tray pan from the machine, and allows the operator to quickly recycle left over ammunition through the machine.

The present invention provides a compact design using much less floor space than the prior art devices.

The present invention provides ease of operation to the operator, not requiring the operator to extend over the machine, nor lift heavy loads in awkward positions.

These and other features of the present invention will be evident from the ensuing description of preferred embodiments and the drawings.

SUMMARY OF THE INVENTION

The present invention provides a compact apparatus for efficient loading of loose ammunition at a high rate into empty cartridge boxes. The apparatus of the present invention, in a first embodiment, uses a bullet manifold having alignment holes formed in a pattern to match the empty cartridge holes in the boxes contained in a tray pan which is indexed below the manifold. The manifold includes side walls, a rear wall and a removable front gate. The loose ammunition is poured onto the manifold and contained there by the walls and front gate.

The manifold is mounted on a vibratory table which shakes the loose ammunition, causing the ammunition to fall into the alignment holes. Once the holes are substantially filled, the operator shuts the machine off and moves the front gate from the front of the manifold towards the rear of the manifold to clear excess ammunition from the manifold. The front gate is retained by detents near the rear of the manifold.

A bullet pan beneath the manifold but above the tray pan prevents the cartridges from falling directly into the tray pan boxes to prevent fouling of the alignment holes. The bullet pan is released by pulling a side detent from a notch in the side of the bullet pan. A spring loaded ejector pin ejects the bullet pan partially from the apparatus so that the operator can grasp and remove the bullet pan from the apparatus.

The cartridges can then fall from the manifold into the empty cartridge boxes in the tray pan. The operator then releases detents on both sides of the apparatus which engage in notches in the tray pan. Spring loaded ejector pins then partially eject the tray pan from the apparatus so the operator can then grasp and remove the tray pan from the apparatus.

The operator then loads a new tray containing empty cartridge boxes back into the apparatus where the resiliently biased detents engage side notches in the tray pan. The bullet pan is then re-inserted into the apparatus where the resiliently biased detent engages the side notch in the bullet pan. The front gate is moved back to the front of the manifold and more ammunition is poured onto the manifold.

The vibratory table is driven by an eccentric drive which is adjustable to vary the amount of vibration of the table. The drive is operated by a drive motor which is fully contained within the base of the apparatus to form a compact design. The manifold itself can be easily angled relative to the base for ease of operation.

In a second embodiment of the present invention, rimmed cartridges are loaded into trays. The manifold of the second embodiment is substantially flat and driven in a front to back motion rather than side to side. The manifold includes rows of parallel rails spaced apart approximately the width of the rimmed cartridges but less than the diameter of the rims. The height of the rails is such that the rims of the cartridge between the rails will extend slightly above the rails when the cartridges are fully inserted into the trays beneath the manifold. A removable spacer bar is mounted at the front end of the manifold to maintain the spacing of the parallel rails.

A tray pan is mounted directly beneath the parallel rails and held in place by releasable detents. A plurality of trays are placed on the tray pan which is then inserted into the device beneath the parallel rails. The removable spacer bar is placed in it's front position. Bulk cartridges are dumped onto the manifold and the motor is activated. The front to back motion rocks the cartridges along the top of the parallel rails. The cartridges fall between the rails and into the trays below. The rims of the cartridges engage the manifold rails to prevent the cartridges from entering the trays upside down. After most of the trays have been filled, the excess cartridges are moved towards the rear of the manifold by hand to clear the manifold and the rear gate is placed in the manifold. The motor is then stopped and any remaining unfilled trays are filled by hand. The spacer bar is removed from the manifold. The detents are then released and the tray pan removed from the apparatus. The cartridge rims disengage from the manifold rails as the tray pan is removed from the apparatus to allow the cartridges to fully seat in the cartridge boxes. New trays are reloaded into the apparatus and the operation is repeated.

These and other features will be evident from the following description of the preferred embodiment in conjunction with the drawings.

BRIEF DESCRIPTION OF THE DRAWINGS

FIG. 3 is a front view of the upper manifold assembly of the present invention.

FIG. 4 is a top view of the manifold assembly of the present invention.

FIG. 7 is a cutaway view of FIG. 6 along line 7—7 showing the drive apparatus.

FIG. 8 is a cutaway view of FIG. 7 along line 8—8 detailing the eccentric drive assembly.

FIG. 9 is a cutaway view of FIG. 8 along line 9—9 showing the adjustable eccentric cam.

FIG. 11 is a front view of the manifold of the embodiment of FIG. 10.

FIG. 12 is a top view of the embodiment of FIG. 10.

DESCRIPTION OF THE PREFERRED EMBODIMENT

Figure 1:
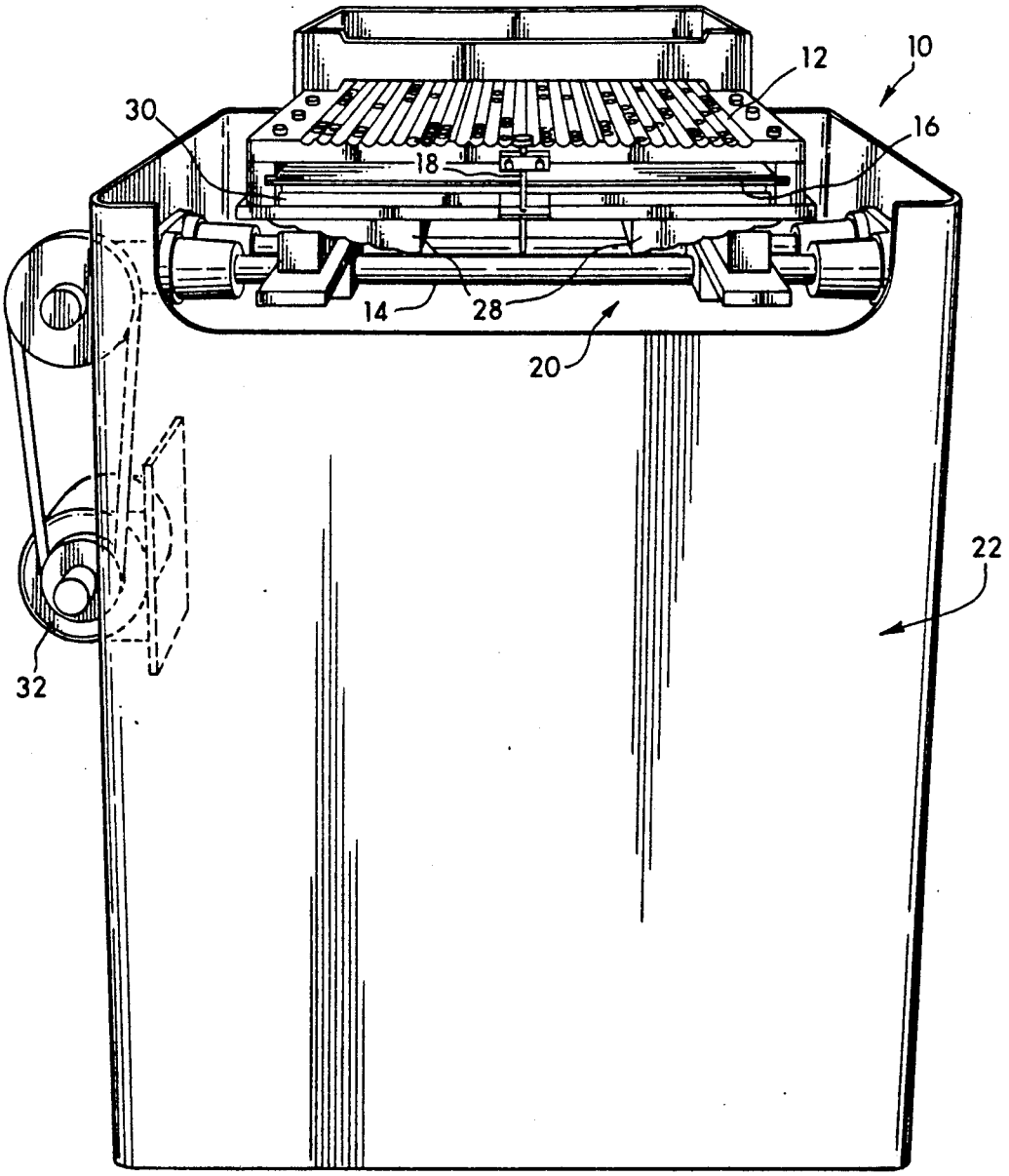
Fig. 1 (Prior Art)
FIG. 1 illustrates a prior art cartridge box loading machine.

A prior art machine for loading loose rimless ammunition into empty cartridge boxes is illustrated in FIG. 1. The prior art machine 10 uses a manifold 12 mounted on a vibratory drive 14 to shake the manifold 12 to cause loose ammunition to fall into alignment holes in the manifold. The ammunition is held in the manifold by a bullet pan 16 which is locked in place by dowel rod 18. The bullet pan 16 is removed so the aligned cartridges in the manifold alignment holes fall into empty cartridge boxes contained in tray pan 30. The tray pan is also held by dowel rod 18.

The manifold is angled relative to the base by the use of shims 28 at the front of the manifold 12. The vibratory drive 14 is driven by a motor 32 mounted externally to the base. This design necessitates the use of a large amount of floor space.

The operator must continuously flood the manifold 12 with excess ammunition in order to fill the alignment holes in the manifold 12. The loose ammunition falls off the sides, rear, and front of the manifold and into the trough area 20 formed on the base 22 of the device. The trough area 20 funnels the loose ammunition through the base 22 where it falls into a bucket. The operator continuously retrieves the bucket and dumps the ammunition contained there back onto the manifold. The trough area of the base extends beyond the manifold, forcing the operator to repeatedly bend over the machine, even while manipulating the relatively heavy bucket of ammunition. This prior art machine is unable to pass rimmed ammunition through the manifold.

A first possible preferred embodiment of the present invention is illustrated in FIGS. 2-9. This embodiment has particular utility in loading rimless cartridges into trays. The box loading apparatus 40 has an open base 42 onto which a bulet manifold 44 is mounted. The bullet manifold 44 has a series of parallel grooves 46 aligned with and parallel of alignment holes 48 are formed in the manifold 44, spaced within each groove 46. The holes are spaced according to a pattern which will be discussed below.

The manifold 44 includes side walls 50, 52 mounted adjacent the sides of the manifold and a rear wall 54 mounted adjacent the rear end of said manifold. Guide slots 56 and 58 are formed near the front end of the manifold by corner pieces. A front gate 64 is slidably mounted into the guide slots 56, 58 and retained in a first position (shown in FIG. 3) substantially perpendicular to the plane of the manifold 44 and movable to a second position (shown in FIG. 2) near the rear of the manifold.

Loose ammunition can be poured on top of the manifold 44 without the ammunition falling off the sides of the manifold 44. The ammunition is contained on top of the manifold by the side walls 50, 52, the rear wall 54 and the front gate 64 in its first position. The front gate 64 is moveable to the second position near the rear of the manifold 44 for reasons that will be set forth below. The front gate 64 is slidable upwards in the guide slots 56, 58 until it contact stops 66, 68. The stops 66, 68 allow the front gate to clear the top of the manifold while preventing the front gate 64 from being moved to a position where ammunition might fall between the front gate and the manifold. The front gate is moveable along the manifold to the second position located near the rear of the manifold.

Resiliently biased detents 70 and 72 are mounted in each of the side walls 50, 52 extending over the manifold. End surfaces 74, 76 as shown in FIG. 4 are formed on the detents 70, 72 angled in a direction away from the side walls and towards the rear of the manifold. The end surfaces 74, 76 terminate in a rear surface perpendicular to the side walls. The detents 70, 72 are attached to the side walls 50, 52 by elongated springs 78, 80 so the detents are resiliently biased in the side walls in a direction perpendicular to the side walls.

As the front gate 64 moves along the top of the manifold, it contacts the end surfaces 74, 76 of the detents 70, 72. The action of the front gate in contacting the angled end surfaces causes the detents to be moved outward from the side walls, to allow the front gate to freely move towards the rear of the manifold. Once the front gate passes the detents, the detents spring back into place. Stops 78 and 80 prevent the front gate from moving further up the manifold. The perpendicular rear surface of the detents then retain the front gate 64 in the second position as shown in FIG. 4.

Figure 5:
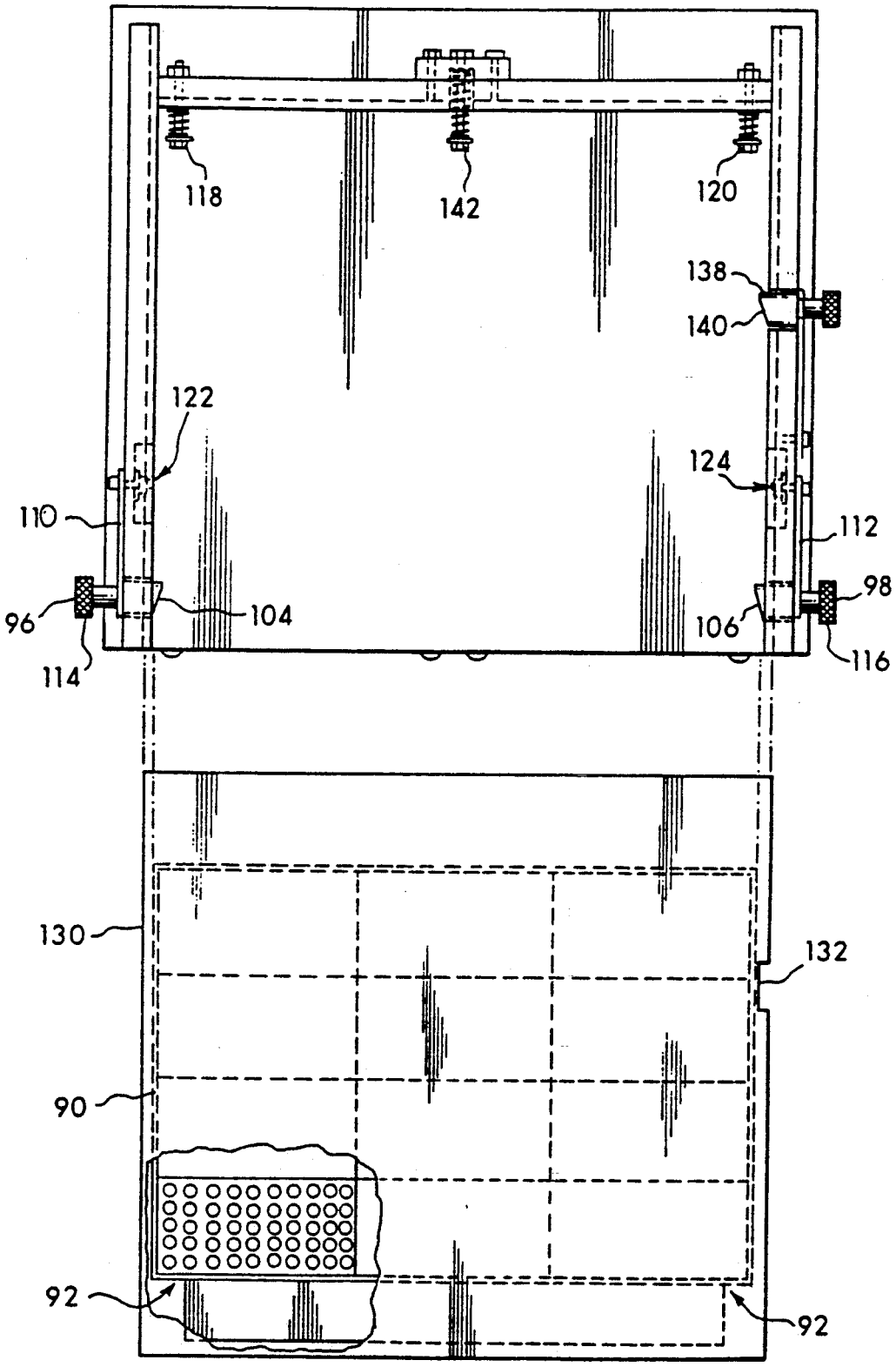
FIG. 5 is a top cutaway view of FIG. 3 along line 5—5 of the manifold assembly showing the bullet pan and tray pan partially removed from the apparatus.

The empty cartridge boxes are placed in the tray pan 90 as shown in FIGS. 3 and 4. Typically, as illustrated in FIG. 5, 12 boxes holding 50 cartridges each are placed in the tray pan 90. The tray pan 90 is insertable in the apparatus at a location below the manifold 44. The alignment holes 48 in the manifold are formed in a pattern matching the array of boxes once the tray pan is fully inserted in the machine.

The tray pan 90 is formed with notches 92 in its sides near the front of the tray pan. Detents 96 and 98 are mounted in the sides 100, 102 of the apparatus into which the tray pan is inserted. These detents are formed with end surfaces 104, 106 angled in a direction away from the side walls and towards the rear of the apparatus. These detents are attached to the apparatus extending into the tray pan insertion area by elongated flat springs 110, 112 which resiliently bias the detents into the tray pan area.

The tray pan 90 thus is freely inserted into the tray pan insertion area of the apparatus with the sides of the tray pan moving the detents 96, 98 away from the tray pan until the detents contact the notches 92. The resilient biasing force of the springs 110, 112 cause the detents to engage in the notches, preventing the tray pan from being removed from the apparatus. The detents include knobs 114, 116 to allow the operator to disengage the detents from the notches to remove the tray pan.

The spring 110, 112 are attached to the apparatus by clamping blocks 122, 124 which are adjustable along the sides of the machine. This allows the detents to be adjusted to align the tray pan so the holes in the cartridge boxes are aligned with the alignment holes 48 of the manifold 44.

Spring loaded ejector pins 118, 120 are mounted in the rear wall of the insertion area of the insertion area. The tray pan abuts against the ejector pins 118, 120, compressing the springs as the detents are engaged in the notches. When the detents are released from the notches, the ejector pins 118, 120 eject the tray pan partially out of the machine so the operator can grasp and remove the tray pan.

A bullet pan 130 shown in FIGS. 3 and 5 is inserted in the machine between the tray pan 90 and the manifold 44. The bullet pan is rectangularly shaped flat sheet of metal. A single notch 132 is formed midway on one side of the bullet pan 130. The bullet pan 130 is inserted in slots 134, 136 formed in the side walls of the apparatus. A detent 138 is mounted along slot 136 extending in the area where the bullet pan is inserted. The detent 138 has an angularly shaped end surface 140 to allow the bullet pan to push the detent out of the way until the detent engages the notch 132.

A flat spring resiliently biases the detent into engagement with the notch to retain the bullet pan in the apparatus. A spring loaded ejector pin 142 is mounted in the rear wall of the apparatus for the bullet pan to abut against as the detent engages the notch. The spring is compressed as the detent is engaged. The operator pulls the knob outward to disengage the detent from the notch. The spring loaded ejector pin then ejects the bullet pan partially out of the apparatus so the operator is able to grasp and remove the bullet pan.

Figure 6:
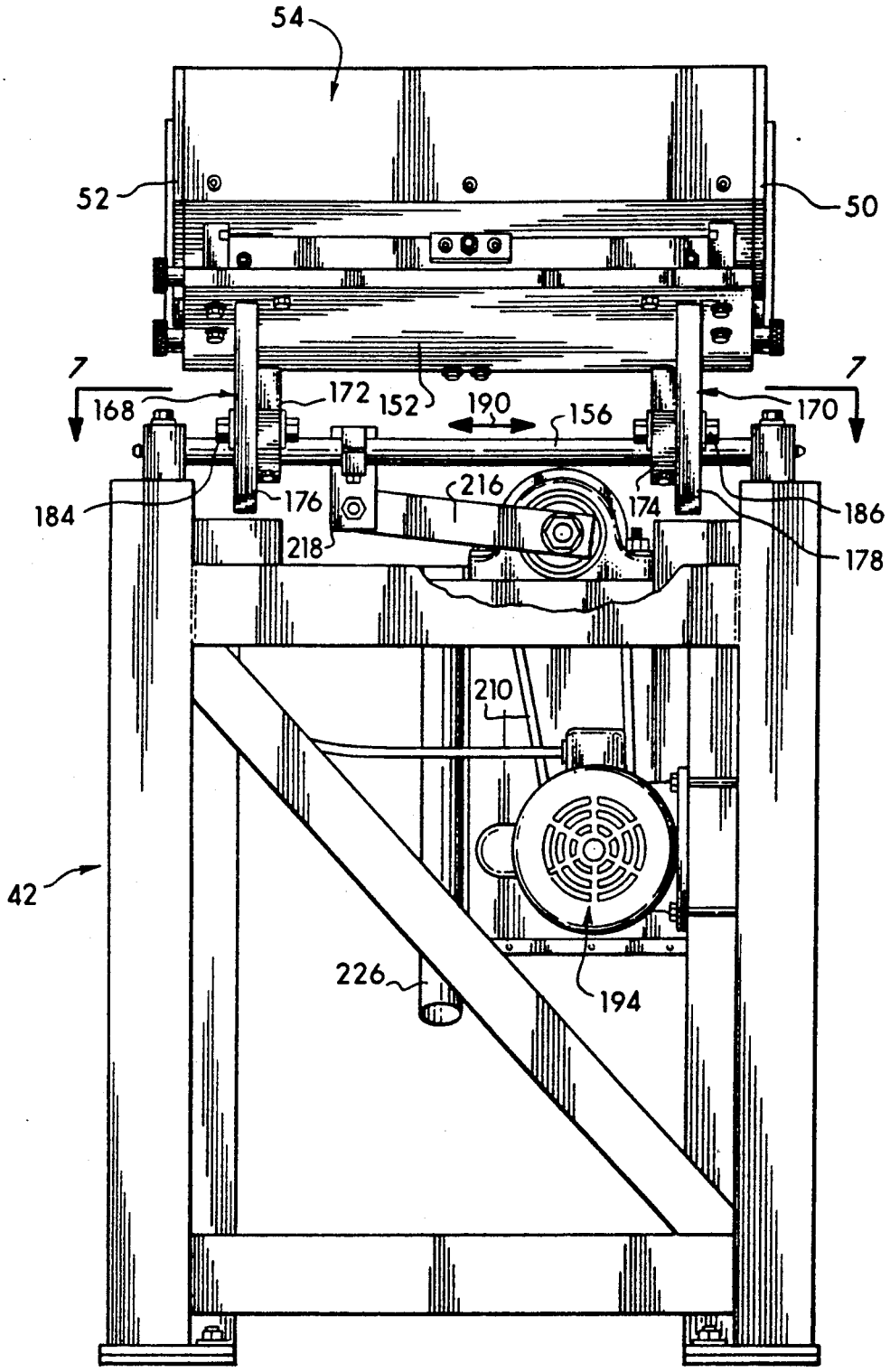
FIG. 6 is a rear view of the apparatus.

The manifold 44 is vibrated by an eccentric drive mechanism 150 mounted beneath the manifold assembly as shown in FIG. 6. The manifold assembly is mounted on a mounting plate 152 as shown in FIGS. 6 and 7. Guide bars 154 and 156 are mounted across the top of the lower base assembly 42 to be supported by the bearing blocks 158, 160. The guide bars 154, 156 are slidable relative to the bearing blocks 158, 160.

The mounting plate 152 is pivotally mounted on the front guide bar 154 by bearing clamps 164 and 166. The plate 152 is adjustable mounted on the rear guide bar 156 by the clamping mounts 168 and 170. The clamping mounts 168, 170 include bar clamps 172, 174 mounted on the rear guide bar 156 and plate clamps 176, 178 mounted on the bottom of the plate 152. The plate clamps 176, 178 each have slots 180, 182 formed therein. The plate clamps and the bar clamps are adjustable clamped together by bolts 184, 186 to mount the plate 152 on the base 42. The angle of the manifold relative to the base can be adjusted from zero to twenty degrees by loosening the bolts 184, 186 and sliding the bolts in the slots 180, 182 to the desired angle. The above recitation of the mounting apparatus is for descriptive purposes only and is not meant to limit the scope of the claimed invention. Other devices for mounting are considered to be within the scope of the inventive concept.

The guide bars 154, 156 are reciprocally driven in the direction of arrow 190 by the eccentric drive mechanism. This drive mechanism thus shakes the manifold to cause the cartridges to fall in the alignment holes 46. The drive mechanism includes a motor 194 mounted internally in the lower base assembly 42. This provides a compact structure allowing a smaller work space.

The motor drives an upper drive assembly mounted below the guide bars 154, 156. The upper drive assembly includes drive shaft 202 rotatably supported on the base assembly by bearing blocks 204, 206. A pulley 208 is attached to one end of the drive shaft 202 and driven by belt 210 which is driven by the motor 194. An adjustable eccentric cam 212 as shown in FIG. 8 and 9 is mounted on the opposing end of the drive shaft which has been machined to be offset from the center of rotation of the shaft by 0.075 inches. The cam 212 has a hole 214 which is offset by 0.075 inches from the outer circumference of the cam. The cam 212 is mounted by the eccentric hole 214 on the eccentric end of the drive shaft. Rotating the cam 212 relative to the drive shaft provides an adjustable eccentric drive variable from 0 to 0.300 inches of total stroke.

Drive arm 216 is mounted on the cam 212 to be reciprocated back and forth as the eccentric cam is rotated by the drive shaft. The drive arm 216 is attached to a guide bar clamp 218 which is mounted on the guide bars. Thus the drive arm 216 reciprocates the guide bars to vibrate or shake the manifold 44. The claimed invention is not meant to be limited to the above description. Other drive mechanisms are considered to be within the scope of the inventive concept.

Figure 2:
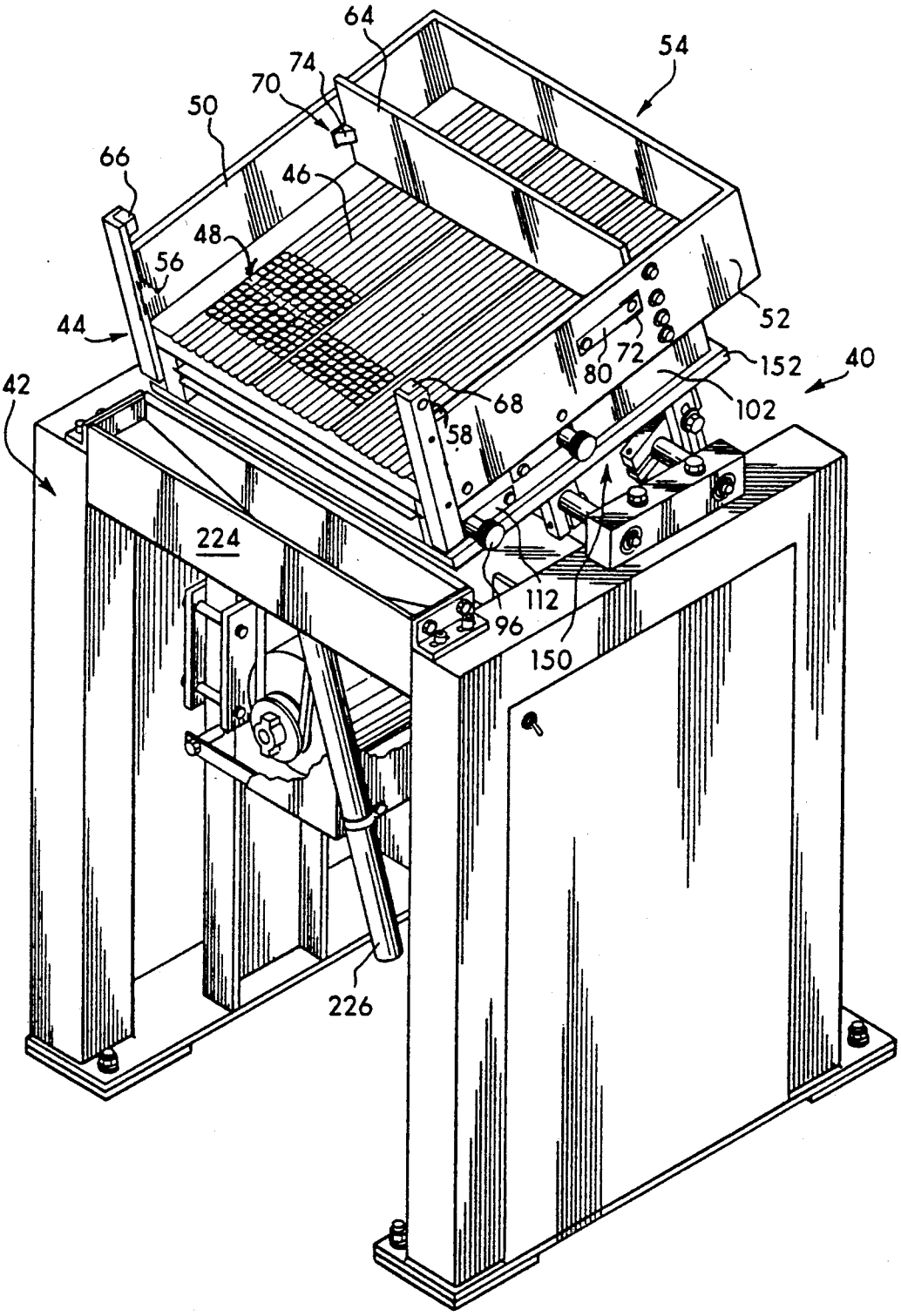
FIG. 2 is a perspective view of the cartridge box loading machine of the present invention.

A funnel assembly 224 is mounted at the front of the base assembly as shown in FIG. 2 to be near the front of the manifold 44. The funnel tube 226 extends from the funnel 224 through the base assembly 42. A container can be placed at the bottom of the tube to catch any ammunition which might fall off the front of the manifold when the front gate is moved.

Operation of the Machine

The front gate 64 is initially secured in position at the front of the manifold 44. The bullet pan 130 is placed in the manifold assembly secured by the detent 138. Tray pan 90 is filled with empty cartridge boxes and inserted in the manifold assembly until the detents 96, 98 ratchet into the slots. If the holes of the cartridge boxes are not properly aligned with the alignment holes 48 of the manifold 44, then the detent clamping blocks 122, 124 are adjusted to index the tray pan 90 in proper position.

Loose ammunition is poured onto the top of the manifold and contained there by the side walls 50, 52, rear wall 54 and front gate 64. The motor 194 is activated, causing the manifold to be reciprocated. This action shakes the cartridges into the grooves 46. The shaking action and the angle of the manifold causes the cartridges to fall into the alignment holes 48. The angle of the manifold and the adjustable eccentric cam 212 are adjusted to control the operating speed of the apparatus.

Once the alignment holes 48 are substantially filled, the operator turns the drive motor 194 off. The front gate 64 is moved up the manifold, pushing the excess cartridges into a storage area at the rear of the manifold. The detents 70, 72 secure the front gate 64 so the operator can fill any remaining empty alignment holes 48 by hand.

The operator releases the detent 138 from the bullet pan 130. The spring loaded ejector pin 142 ejects the bullet pan partially out of the manifold assembly so the operator can grasp and completely remove the bullet pan.

This causes the cartridges to drop out of the manifold and into the empty cartridge boxes. After the cartridge boxes have been filled, the operator pulls knobs 114, 116 to release the detents 96, 98 from the tray pan notches 92. The spring loaded ejector pins 118, 120 eject the tray pan 90 partially out of the manifold assembly so the operator can pull the pan out of the assembly.

The operator the reinserts a new tray pan containing empty cartridge boxes into the manifold assembly until the detents 96, 98 engage the pan notches 92. The bullet pan 130 is also reinserted and more ammunition poured onto the manifold. The operator restarts the drive motor and the operation is repeated.

Second Preferred Embodiment

A second preferred embodiment is illustrated in FIGS. 10–14. This embodiment enables rimmed cartridges to loaded into trays in a manner substantially similar to the above-described embodiment.

Box-loading apparatus 300 for loading rimmed cartridges includes an open base 310 similar to the base of the above-described embodiment upon which manifold assembly 320 is mounted. Manifold assembly 320 includes a rear wall 322 and side walls 324, 326 to contain loose cartridges in the manifold assembly. Movable rear gate 328, identical to the movable front gate 64 of the above-described embodiment, is no longer used in the first position at the front of manifold assembly 320, only at the second position, shown in FIG. 10. Rear gate 328 is useable in the second position near the rear of the manifold assembly 320 for reasons that will be set forth below. This portion of manifold assembly 320 is similar to the manifold assembly of the above-described embodiment.

Resiliently biased detents 342, 344, shown in FIG. 12, are mounted in side walls 324, 326 extending over manifold plate 360. End surfaces 346, 348 are formed on the detents 342, 344 angled in a direction away from the side walls and towards the rear of the manifold. End surfaces 346, 348 terminate in a rear surface perpendicular to the side walls. The detents 342, 344 are attached to the side walls 324, 326 by elongated flat springs 350, 352 so the detents are resiliently biased in the side walls in a direction perpendicular to the side walls.

As rear gate 328 moves along the top of the manifold, it contacts the end surfaces 346, 348 of the detents 342, 344. The action of the rear gate in contacting the angled end surfaces causes the detents to be moved outward from the side walls, to allow the rear gate to freely move towards the rear of the manifold. Once the rear gate passes the detents, the detents spring back into place. Stops 354, 356 prevent rear gate 328 from moving further up the manifold. The perpendicular rear surface of detents 342, 344 then retain rear gate 328 in the second position as shown in FIG. 12. The manifold assembly 320 as described so far is similar to the manifold assembly of the earlier described embodiment of the present invention.

Manifold assembly 320 includes manifold plate 360 having rear portion 362 defined by the second position of rear gate 328, discussed above, and cartridge loading portion 364. Manifold plate 360 includes a plurality of parallel, spaced rails 366. Rails 366 are spaced apart a distance greater than the diameter of the body of the cartridges C but less than the diameter of the rims of the cartridges C. Support bars 368 are provided at predetermined distances to add support to the manifold plate. The spacing of rails 366 and bars 368 are designed to accommodate standard size cartridge trays. The spacing of the rails and bars can be configured as necessary for different sizes of cartridges and different sizes and shapes of cartridge trays. In the descriptive embodiment, 12 trays containing 50 cartridges each are loaded at a time.

Rails 366 are clamped between support blocks 370 in rear portion 362 of manifold 360. Front spacer member 372, shown in FIG. 11, is removably mounted on the front end of manifold plate 360 to maintain the spacing between rails 366 during the cartridge loading operation. Front spacer member 372 includes a plurality of spacers 374 extending downward to maintain the spacing of rails 366 during the loading process. Once the trays have been filled, as discussed below, front spacer member 372 is removed from the manifold to allow the filled trays to be removed.

Tray pan 380 is identical to tray pan 90 of the first embodiment. Tray pan 380 is substantially flat with sides to hold trays thereon. Notches 382, 384 are formed in the sides of the tray pan near the front of the tray pan. Detents 386, 388 are mounted in the sides of the apparatus directly beneath manifold plate 360 for insertion of tray pan 380. These detents are formed with end surfaces 390, 392 angled in a direction away from the side walls and towards the rear of the apparatus. These detents are attached to the apparatus extending into the tray pan insertion area by elongated flat springs 394, 396 which resiliently bias the detents into the tray pan area.

The tray pan 380 thus is freely inserted into the tray pan insertion area of the apparatus with the sides of the tray pan moving detents 386, 388 away from the tray pan until the detents contact the notches 382, 384. The resilient biasing force of the springs 394, 396 cause the detents to engage in the notches, preventing the tray pan from being removed from the apparatus. The detents include knobs 398, 400 to allow the operator to disengage the detents from the notches to remove the tray pan.

Springs 394, 396 are no longer attached to the apparatus by clamping blocks as described in the earlier embodiment. Instead, springs 394, 396 are permanently fixed in one position with standard cap screws. Since the spacer rails 366 have replaced the individual holes in the earlier described embodiment, adjustable detents are no longer necessary.

Spring loaded ejector pins (not shown), also as described in the earlier embodiment, are mounted in the rear wall of the insertion area of the insertion area. The tray pan abuts against the ejector pins compressing the springs as the detents are engaged in the notches. When the detents are released from the notches, the ejector pins eject the tray pan partially out of the machine so the operator can grasp and remove the tray pan.

Figure 14:
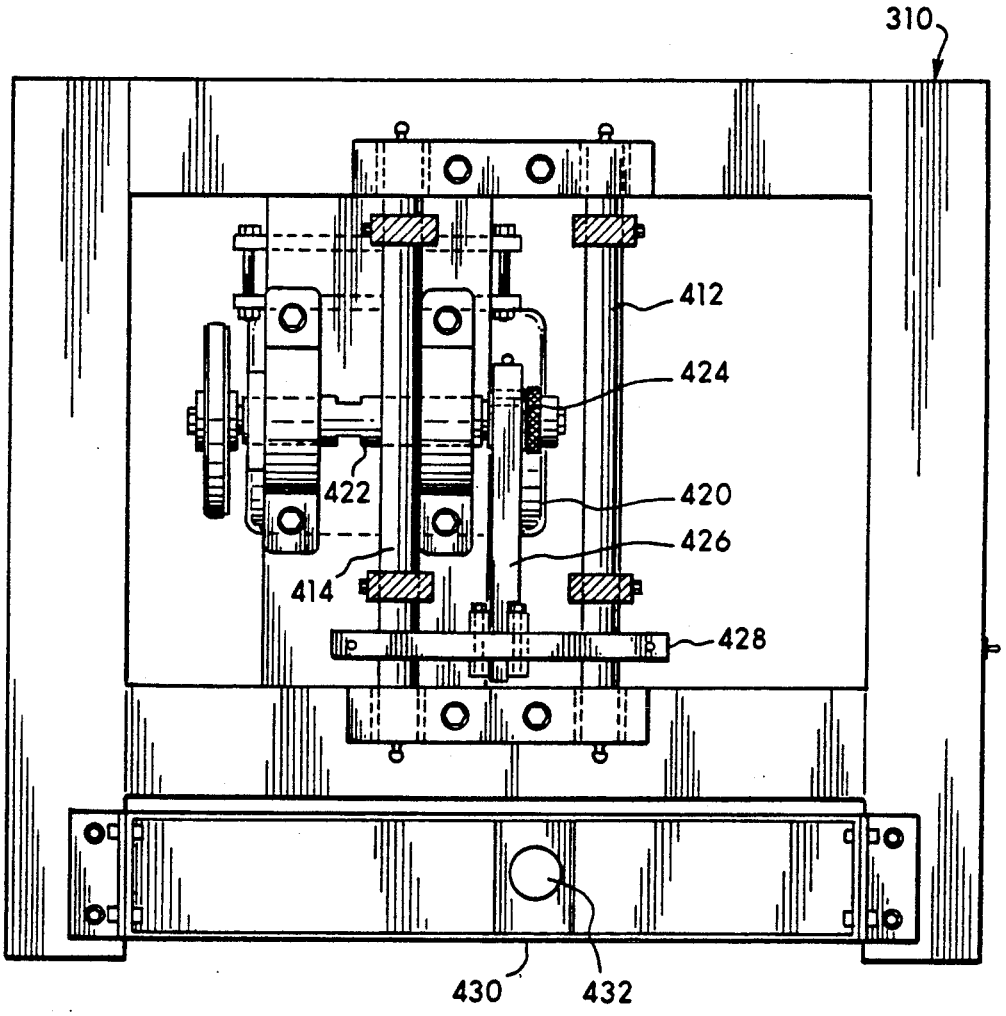
FIG. 14 is a cutaway view of the embodiment of FIG. 11 along lines 14—14.

Manifold assembly 320 is driven by a motor drive assembly identical to the motor drive assembly of the earlier described embodiment with two exceptions. The motor drive assembly of the second embodiment has been rotated ninety degrees on base 310 as illustrated in FIG. 14. The second modification as compared with the earlier embodiment includes mounting manifold assembly 320 substantially flat on guide bars 412, 414 which are mounted on the underside of manifold assembly 320 extending front to back rather than side to side. The remaining drive assembly operates identically to the earlier embodiment. Drive motor 420 rotates drive shaft 422 on which eccentric cam 424 is mounted. Drive arm 426 is mounted on eccentric cam 424 and attached to guide bar clamp 428 to reciprocate guide bars 412, 414 back and forth. Drive motor 420 is activated by switch 440, shown in FIG. 10.

Figure 10:
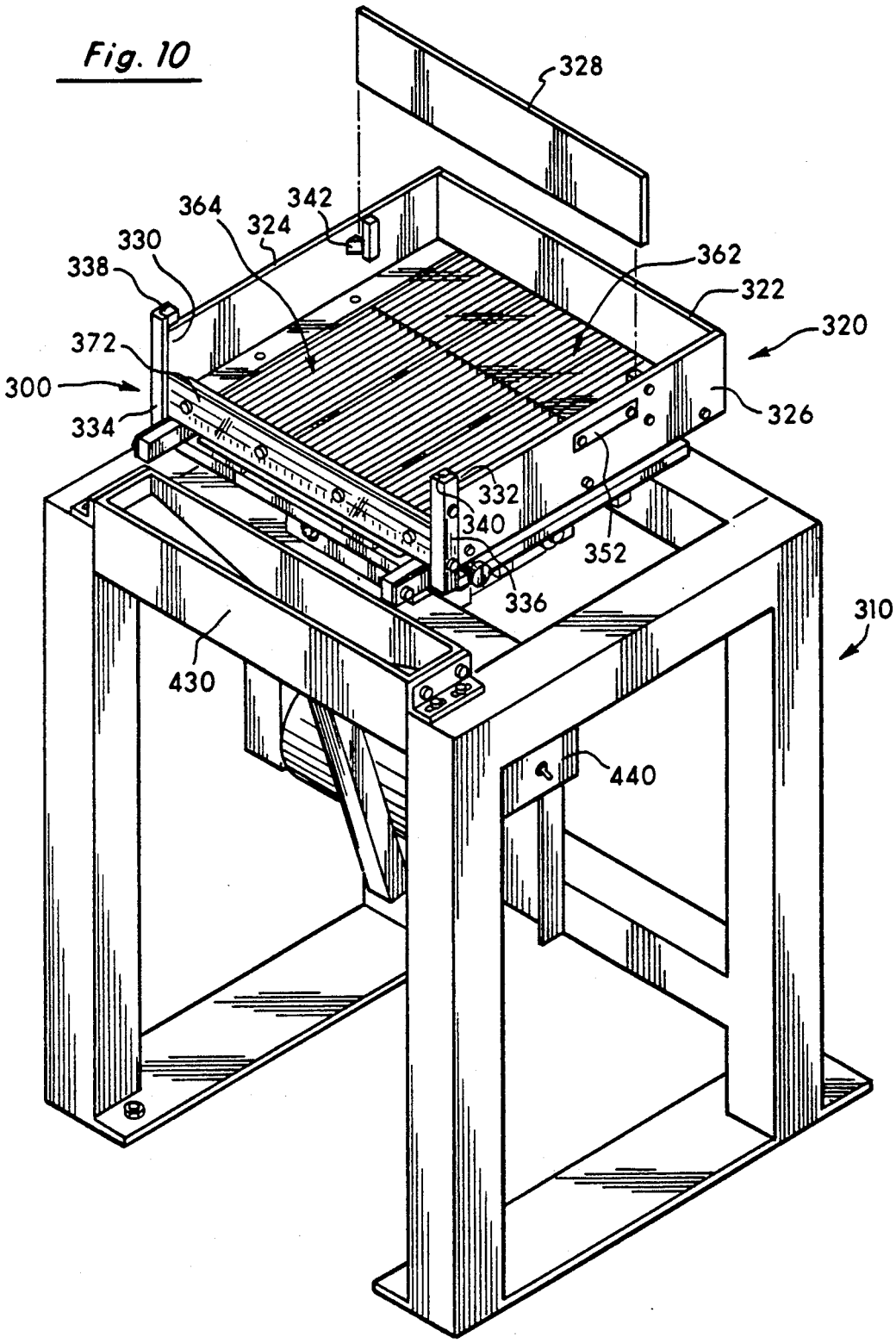
FIG. 10 is a perspective view of a second possible preferred embodiment of the present invention.

Funnel assembly 430, identical to the funnel assembly of the earlier embodiment, is mounted at the front of the base assembly as shown in FIG. 10 to be near the front of the manifold assembly 320. Funnel tube 432 extends from the funnel 430 through the base assembly 310. A container can be placed at the bottom of the tube to catch any ammunition which might fall off the front of the manifold when the front spacer member 372 is moved.

Operation of Second Embodiment

Rear gate 328 is initially secured in position near the rear of the manifold assembly 320. Tray pan 380 is filled with empty cartridge boxes and inserted in the manifold assembly until detents 386, 388 ratchet into slots 382, 384. Spacer member 372 is placed on the front of the manifold so that spacers 374 maintain the spacing of rails 366. Rear gate 328 is removed and set aside.

Loose ammunition is poured onto the top of the manifold and contained there by the side walls 324, 326, rear wall 322 and front spacer member 372. Motor 420 is activated by switch 440, causing the manifold to be reciprocated in a front to back motion. This action shakes the cartridges into the grooves between rails 366. The rims on the cartridges prevent the cartridges from falling into the grooves between rails 366 upside down. The cartridges will thus fall bullet end downward into the trays beneath the manifold. The rims of the cartridges, as shown in FIG. 11, engage rails 366 to allow the cartridges to partially seat in the trays.

Once the trays are substantially filled, the operator switches the motor off. Rear gate 328 is moved along the manifold to the rear manifold position, pushing the excess cartridges into a storage area at the rear of the manifold by hand. Detents 342, 344 secure rear gate 328 so the operator can fill any remaining empty holes in the trays by hand.

Figure 13:
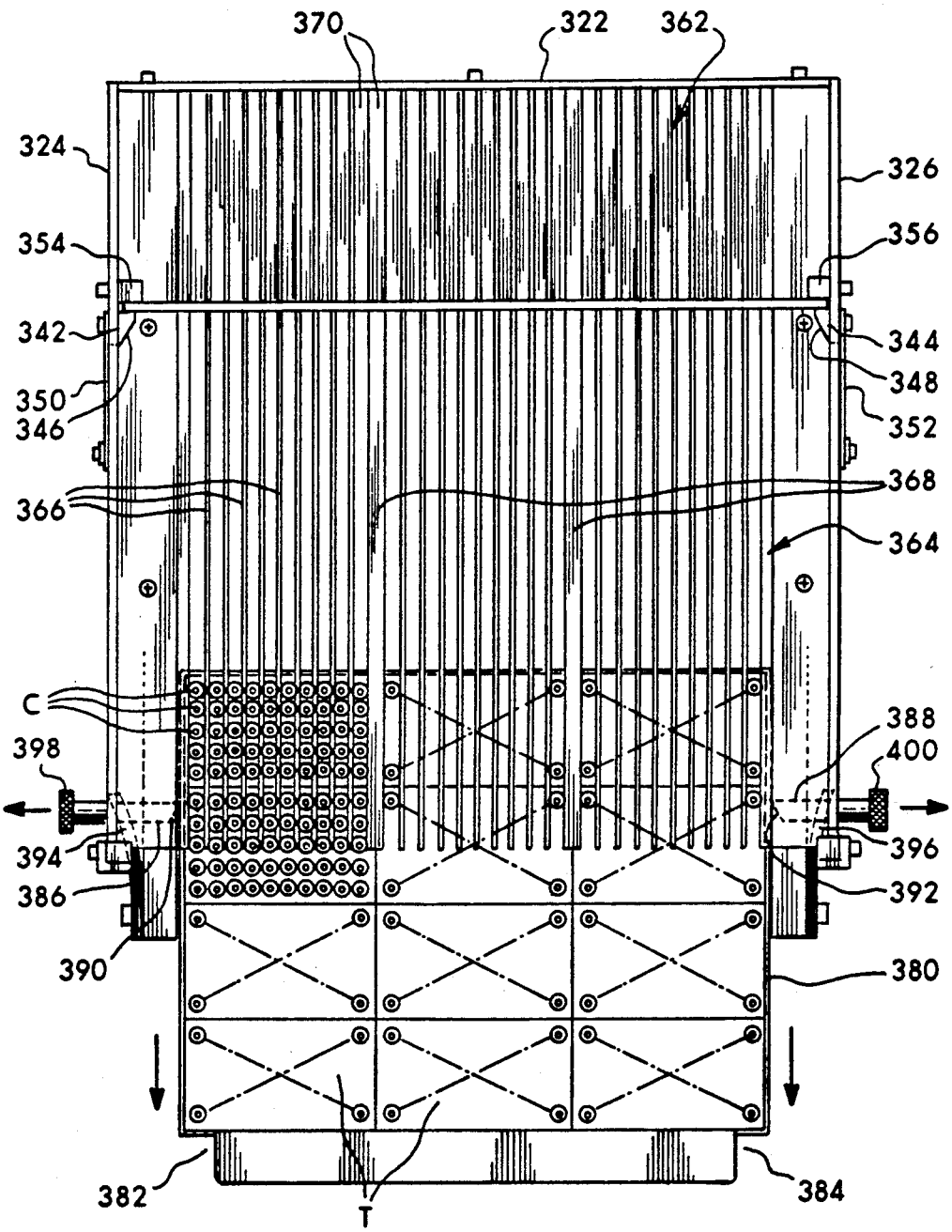
FIG. 13 is a top view of the embodiment of FIG. 10 with the tray pan partially removed.

The operator removes front spacer member 372 from the manifold and releases detents 386, 388 by pulling knobs 398, 400 outward. The spring loaded ejector pins eject tray pan 380 partially out of the manifold assembly so the operator can pull the pan out of the assembly. The cartridge rims, as illustrated in FIG. 13, disengage from rails 366 as tray pan 380 is pulled out of the manifold assembly by the operator. The partially seated cartridges will thus drop in sequential rows to fully seat in the trays.

The operator then reinserts a new tray pan containing empty cartridge boxes into the manifold assembly until detents 386, 388 engage the pan notches 382, 384. The front spacer member is replaced, the rear gate 328 is removed, more ammunition is poured onto the manifold and the operation is repeated.

The present invention is not meant to be limited to the above descriptions of possible preferred embodiments. Other variations and modifications are considered to be within the scope of the inventive concept. The above description was for purposes of explanation and is not meant to limit the invention as claimed.

The apparatus and method of the present invention provides a compact structure which increases the amount of work space available in the loading process. The invention provides a much more efficient process than by hand, increasing the loading rate up to twice the number of rounds per hour and provides a loading process which places less strain on the operator. These and other features are greatly appreciated in the art over the prior machines and processes.

1. An apparatus for loading rimmed ammunition into boxes, said apparatus comprising:

a base assembly;

a bullet manifold mounted on said base assembly and having guide means;

a tray pan indexed beneath said bullet manifold aligned with said manifold guide means and sized to position a plurality of empty cartridge boxes into alignment with said guide means;

said guide means on said manifold being configured to guide ammunition into alignment with said empty cartridge boxes and to prevent rimmed ammunition from passing through said guide means;

means mounted on said base assembly for vibrating said bullet manifold to move ammunition into alignment with said guide means;

side walls mounted adjacent three sides of said bullet manifold to contain the loose ammunition on said manifold; and a removable spacer bar mounted in a position near the front of said manifold and a removable rear gate positioned in a second position near the rear of said manifold.

2. The apparatus of claim 1 wherein said guide means include a plurality of parallel rails spaced apart a distance greater than the diameter of the body of said rimmed ammunition but less than the diameter of the rims of said rimmed ammunition.

3. The apparatus of claim 1 wherein guide means further comprise means for preventing said rimmed ammunition from being inserted into said cartridge boxes upside down.

4. The apparatus of claim 3 wherein said guide means include a plurality of parallel rails spaced apart a distance greater than the diameter of the body of said rimmed ammunition but less than the diameter of the rims of said rimmed ammunition.

5. The apparatus of claim 2 wherein said guide means further include means for maintaining the spacing of said parallel rails during the loading process.

6. The apparatus of claim 1 wherein said manifold is mounted to be substantially horizontally on said base.

7. The apparatus of claim 1 wherein said manifold is vibrated in a substantially front to back direction of motion.

8. The apparatus of claim 1 wherein said means to vibrate said manifold includes means for varying the amount of vibration of said bullet manifold.

9. The apparatus of claim 8 wherein said means for varying the vibration of said bullet manifold comprises a variable eccentric drive.

10. The apparatus of claim 1 wherein said apparatus further comprises means for allowing said tray pan to be freely inserted into said apparatus, said tray pans means further include means for releasably detaining said tray pan from removal from said apparatus.

11. The apparatus of claim 10 wherein said tray pan includes notches formed in the sides of said tray pan; and said tray pan detaining means comprise resiliently biased detents having end surfaces angled in a direction away from said manifold sides and towards the rear of said manifold so as said tray pan is inserted into said apparatus, said tray pan detents are moved towards said manifold sides until said tray pan detents contact said tray pan notches wherein said resilient biasing moves said detents into said notches to detain said tray pan.

12. The apparatus of claim 11 wherein said apparatus further includes means for ejecting said tray pan from said apparatus.

13. An apparatus for loading rimmed ammunition simultaneously into a plurality of cartridge boxes, said apparatus comprising:

a base assembly;

a bullet manifold mounted on said base assembly;

side walls mounted adjacent the sides of said bullet manifold to contain the loose ammunition on said bullet manifold;

a tray pan containing a plurality of empty cartridge boxes indexed beneath said bullet manifold;

means for allowing said tray pan to be freely inserted into said apparatus;

means for releasably detaining said tray pan from removal from said apparatus;

means on said bullet manifold for guiding rimmed ammunition into simultaneous alignment with the plurality of empty cartridge boxes on said tray pan while preventing the rimmed ammunition from passing entirely through said bullet manifold and for preventing the rimmed ammunition from being aligned upside down with the plurality of empty cartridge boxes; and means mounted on said base assembly for vibrating said bullet manifold to move the rimmed ammunition into alignment with said guiding and aligning means.

14. The apparatus of claim 13 wherein said apparatus further comprises a storage area adjacent the rear of said bullet manifold; and a rear gate removably mounted near said storage area of said manifold and movable along said manifold to wipe excess cartridges into said storage area.

15. The apparatus of claim 13 wherein said tray pan includes notches formed in the sides of said tray pan; and said tray pan detaining means comprise resiliently biased detents having end surfaces angled in a direction away from said manifold sides and towards the rear of said manifold so as said tray pan is inserted into said apparatus, said tray pan detents are moved towards said manifold sides until said tray pan detents contact said tray pan notches wherein said resilient biasing moves said detents into said notches to detain said tray pan; and said tray pan means further include means to eject said tray pan from said apparatus.

16. The apparatus of claim 13 wherein said guiding and aligning means include a plurality of parallel rails spaced apart a distance greater than the diameter of the body of said rimmed ammunition but less than the diameter of the rims of said rimmed ammunition.

17. A method of loading rimmed ammunition into cartridge boxes having holes using a box loading apparatus, said method comprising the steps of:

(a) inserting a tray pan containing a plurality of cartridge boxes under a bullet manifold having containment walls;

(b) loading loose ammunition onto said bullet manifold;

(c) activating means for vibrating said bullet manifold to align said loose ammunition into grooves formed by a plurality of rails spaced apart a distance greater than the diameter of the bodies of said rimmed ammunition but less than the diameter of the rims of said rimmed ammunition on said bullet manifold;

(d) stopping said vibratory means once the holes in said cartridge boxes are substantially filled with said loose rimmed ammunition;

(e) moving a rear gate along said bullet manifold to remove the excess of said ammunition from said bullet manifold; and (f) removing said tray pan from said apparatus once said cartridge boxes are substantially filled.

18. The method of claim 17 wherein said method further includes the steps of:

(g) inserting a new tray pan filled with empty boxes into said apparatus; and (h) repeating the operation to fill said empty boxes.

19. The method of claim 17 wherein said step (e) further includes moving said rear gate past resiliently biased detents that releasably retains said rear gate in a position near the rear of said bullet manifold.

20. The method of claim 17 wherein said step (g) includes releasing detent means mounted in said apparatus to release said tray pan from said apparatus.

* * * * *